US010580636B2

(12) United States Patent
Chutjian et al.

(10) Patent No.: US 10,580,636 B2
(45) Date of Patent: Mar. 3, 2020

(54) ULTRAHIGH RESOLUTION MASS SPECTROMETRY USING AN ELECTROSTATIC ION BOTTLE WITH COUPLING TO A QUADRUPOLE ION TRAP

(71) Applicant: California Institute of Technology, Pasadena, CA (US)

(72) Inventors: Ara Chutjian, La Crescenta, CA (US); John A. MacAskill, Denver, CO (US)

(73) Assignee: CALIFORNIA INSTITUTE OF TECHNOLOGY, Pasadena, CA (US)

( * ) Notice: Subject to any disclaimer, the term of this patent is extended or adjusted under 35 U.S.C. 154(b) by 739 days.

(21) Appl. No.: 15/234,848

(22) Filed: Aug. 11, 2016

(65) Prior Publication Data

US 2017/0047218 A1 Feb. 16, 2017

Related U.S. Application Data

(60) Provisional application No. 62/204,040, filed on Aug. 12, 2015.

(51) Int. Cl.
*H01J 49/00* (2006.01)
*H01J 49/42* (2006.01)

(52) U.S. Cl.
CPC ..... *H01J 49/4245* (2013.01); *H01J 49/424* (2013.01)

(58) Field of Classification Search
CPC ..... H01J 49/00; H01J 49/22; H01J 49/0031; H01J 49/42; H01J 49/4225
See application file for complete search history.

(56) References Cited

U.S. PATENT DOCUMENTS 6,373,052 B1 * 4/2002 Hoyes ..... H01J 49/0036 250/282
6,888,130 B1 * 5/2005 Gonin ..... H01J 49/027 250/281
9,159,544 B2 * 10/2015 Ding ..... H01J 49/027

OTHER PUBLICATIONS

Chutjian, A., et al., "Applications of New Mass-Spectrometric Methods to Medicine", pp. 1-18, downloaded on Jan. 11, 2019 from website https://medeng.jpl.nasa.gov/files/MS%20and%20Chemical%20Markers%20for%20Disease.pptx.

* cited by examiner

*Primary Examiner* — David E Smith
*Assistant Examiner* — Hsien C Tsai
(74) *Attorney, Agent, or Firm* — Gates & Cooper LLP

(57) ABSTRACT

An apparatus for measuring mass of one or more ions, the apparatus including an ion trap coupled to an electrostatic ion bottle (EIB).

20 Claims, 5 Drawing Sheets

ULTRAHIGH RESOLUTION MASS SPECTROMETRY USING AN ELECTROSTATIC ION BOTTLE WITH COUPLING TO A QUADRUPOLE ION TRAP

CROSS REFERENCE TO RELATED APPLICATIONS

This application claims the benefit under 35 U.S.C. Section 119(e) of commonly-assigned U.S. Provisional Patent Application Ser. No. 62/204,040, filed on Aug. 12, 2015, by Ara Chutjian and John A. MacAskill, entitled "ULTRAHIGH RESOLUTION MASS SPECTROMETRY USING AN ELECTROSTATIC ION BOTTLE WITH COUPLING TO A QUADRUPOLE ION TRAP", which application is incorporated by reference herein.

STATEMENT REGARDING FEDERALLY SPONSORED RESEARCH AND DEVELOPMENT

The invention described herein was made in the performance of work under a NASA contract NNN12AA01C, and is subject to the provisions of Public Law 96-517 (35 USC 202) in which the Contractor has elected to retain title.

BACKGROUND OF THE INVENTION

1. Field of the Invention

This invention relates to a mass spectrometer.

2. Description of the Related Art

In many fields of space research, it is necessary to determine both the mass of a species in a planetary environment as well as its abundance. For complex environments, such as Titan or Mars, a comet, or asteroid, one will encounter heavy species (e.g., tholins at Titan), or species that will be unknown and possibly biological in nature (Titan, Mars, asteroids). In all cases one needs to have well-resolved mass spectra up to the highest masses (order of thousands of amu), and accurate measurements of isotope ratios. One also requires high mass resolving power and high mass range in biological applications, when examining large protein molecules. At the moment, there is no technology that will provide high-mass storage, ultrahigh resolution, and total ion abundance. One or more embodiments of the present invention satisfy this need.

SUMMARY OF THE INVENTION

One or more embodiments of the present invention disclose an apparatus for measuring mass of one or more ion types (positive or negative ions), comprising an ion trap (e.g., a quadrupole ion trap, QIT) and an electrostatic ion bottle (EIB) interfaced with the ion trap, wherein the EIB comprises a cavity bounded by a first electrostatic mirror and a second electrostatic mirror at opposite ends of the cavity.

One or more control processors control the injection of the one or more ion types into the EIB from the ion trap. Specifically, the one or more processors control application of one or more transfer voltages to electrodes of the ion trap to eject the one or more ion types from the ion trap. An entry gate comprising an electrode interfaces the EIB with the ion trap, so that the entry gate transfers one or more of the ion types ejected from the ion trap into the cavity. The one or more processors further control a timing and phase of a gate voltage (applied to the entry gate) with respect to the transfer voltages, such that the gate voltage opens the entry gate allowing the one or more ion types to pass into the cavity.

Subsequently, one or more control processors control timing, phase, and magnitudes of a first voltage applied to the first mirror and a second voltage applied to the second mirror. When the first and second voltages are applied with the appropriate timing and phase, an electrostatic field at the first mirror resulting from the first voltage repels the ion types towards the second mirror, and an electrostatic field at the second mirror resulting from the second voltage repels the ion types towards the first mirror, thereby causing the ion types to resonantly oscillate in the cavity between the two mirrors. The apparatus further comprises (1) electrodes positioned and biased with focusing voltages that focus the one or more ion types in the cavity, and (2) electrodes positioned and biased with accelerating/decelerating voltages that accelerate and/or decelerate the one or more ion types in the cavity.

The apparatus further comprises a first detector (measuring the frequencies at which the ion types oscillate in the cavity) and a second detector (detecting the total number of all the ion types in the cavity), The mass m of each ion type is determined (e.g., using a processor connected to the EIB) from the oscillation frequency of that ion type in the cavity. For example, the processor can determine the mass comprising an unknown mass of one ion type by comparing the oscillation period obtained for the unknown mass with the oscillation period obtained for the known mass of another ion type.

The first detector can comprise capacitive pickup electrodes at the center plane of the cavity, wherein the pickup electrodes output data from which the oscillation periods of the various ion types are measured.

The second detector can comprise an electron multiplier positioned behind the downstream mirror.

In one or more embodiments, the mass m is determined with a resolving power ($m/\Delta m$) of at least $10^5$, where $\Delta m$ is an uncertainty in the measured mass, by:

(1) mechanically connecting/supporting the electrodes, the detectors, the mirrors, and the ion trap to/with a frame;

(2) co-axially aligning the electrodes, the detectors, the mirrors, and the ion trap along the longitudinal axis of the cavity;

(3) applying the focusing voltages to control the injection angle of the one or more ion types into the cavity and focus the one or more ion types into an ion-beam having an optimum diameter;

(4) applying the accelerating/decelerating voltages to control an energy width of the one or more ion types in the cavity; and (5) applying the transfer voltages to control a density of the one or more ion types in the cavity.

BRIEF DESCRIPTION OF THE DRAWINGS

Referring now to the drawings in which like reference numbers represent corresponding parts throughout.

DETAILED DESCRIPTION OF THE INVENTION

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Technical Description

Apparatus

Figure 1:
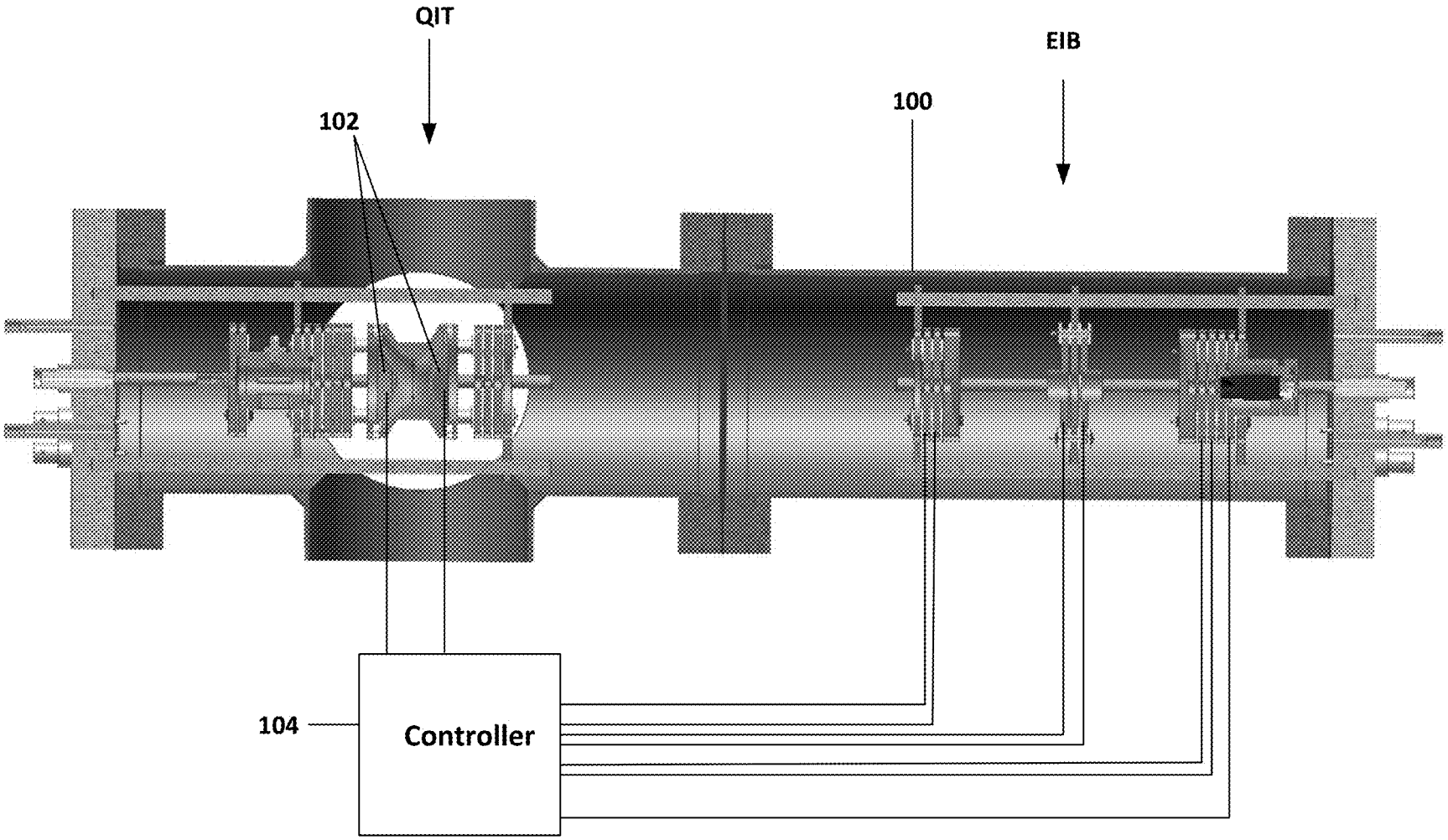
FIG. 1 illustrates a QIT mass spectrometer and the EIB according to one or more embodiments of the present invention.

FIG. 1 illustrates a mass spectrometer comprising a Quadrupole Ion Trap (QIT) interfaced to an Electrostatic Ion Bottle (EIB). The QIT is capable of storing a large number of ions (order of one million) and the EIB can achieve ultrahigh mass resolving power of these ions of order $m/\Delta m=10^5$-$10^6$, where the ion mass m can be large—100,000 amu or greater. In one or more embodiments, the output of the EIB is a fast particle detector (such as a microchannel plate, or channel-type electron multiplier) that counts the number of ions trapped in the EIB. The QIT and the EIB are coaxial and can share the same housing, enclosure, or frame 100.

FIG. 1 further illustrates QIT electrodes 102 and a controller unit 104 (comprising processors and voltage supplies) connected to the QIT and EIB for applying voltages and reading out from the QIT and EIB, as discussed below.

Figure 2:
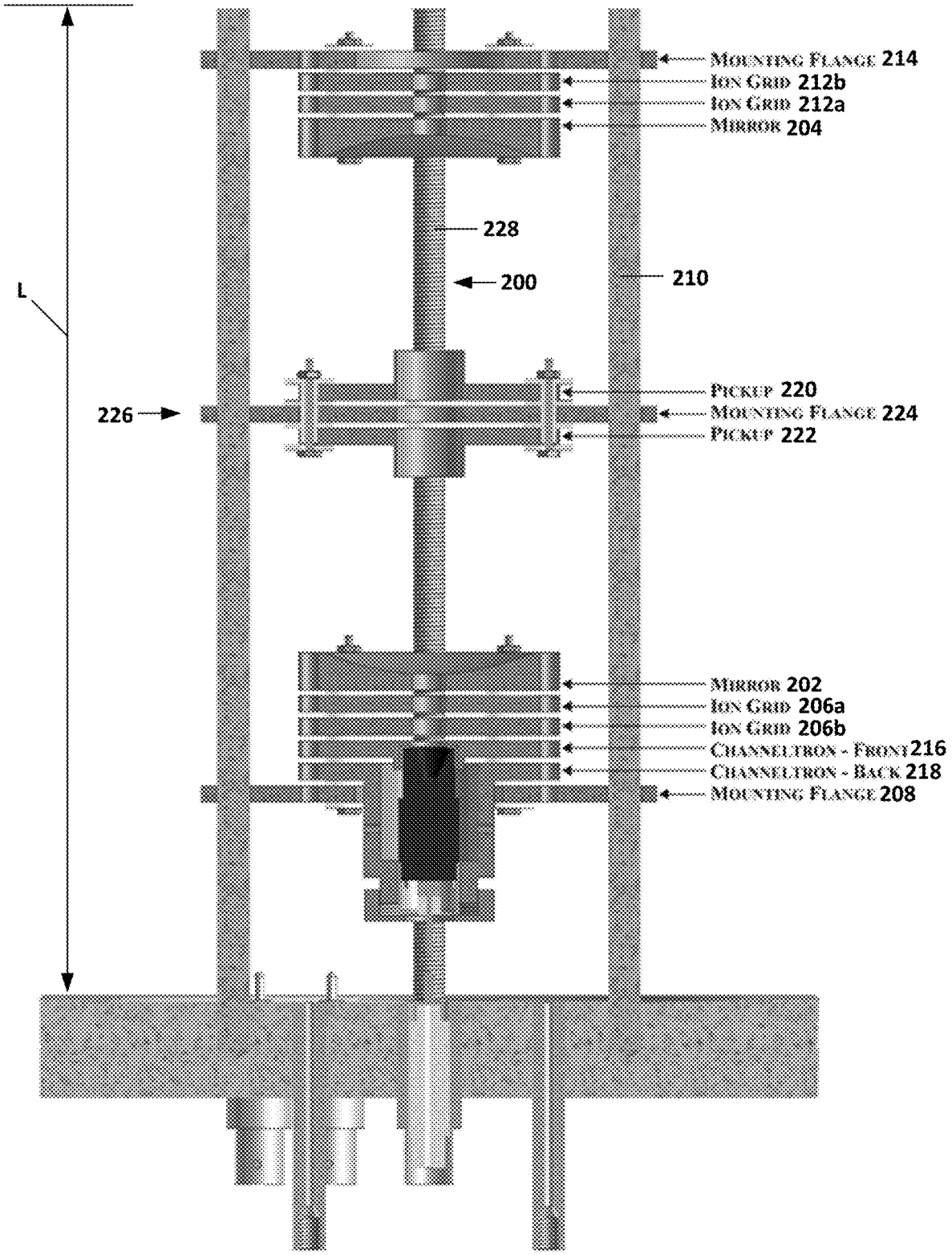
FIG. 2 illustrates the EIB that can be used with the mass spectrometer QIT according to one or more embodiments of the present invention.

FIG. 2 illustrates the EIB comprising a cavity 200 bounded by a first metal mirror 202 and a second metal mirror 204 at opposite ends of the cavity 200. In this embodiment, the mirrors 202, 204 are spherical, although other shape mirrors (including, but not limited to, parabolic mirrors, other curved mirrors, or parallel-plate mirrors) can also be used. The metal mirrors 202, 204 should be made from a non-magnetic metal, such as chemically-pure titanium, or molybdenum. Similarly, all electrode/grids, and the can 100 should made of the same non-magnetic material to prevent aberrations of the ion trajectories arising from electrical contact potentials and stray magnetic fields.

After ions are transferred to the cavity 200 from the ion trap (QIT), a first potential or voltage applied to the first mirror 202 is selected to create an electrostatic field (at the first mirror 202) that repels one or more ions in the cavity towards the second mirror. A second potential or voltage applied to the second mirror 204 is selected to create an electrostatic field (at the second mirror 204) that repels the ions towards the first mirror 202. Thus, the first and second voltages, and timing and phase of the first and second voltages are selected, controlled, and tuned by the controller 104 to cause the ions to resonantly oscillate in the cavity between the first mirror 202 and the second mirror 204.

The EIB further comprises a first pair of electrodes (ion grids 206*a* and 206*b*) between the first mirror 202 and a first mounting flange 208, wherein the first mirror 202 and the ion grids 206*a-b* are fastened to the first mounting flange 208; and the first mounting flange 208 is fixed to the frame or enclosure 210 of the EIB. A second pair of electrodes (ion grids 212*a* and 212*b*) is between the second mirror 204 and a second mounting flange 214. The second mirror 204 and the ion grids 212*a-b* are fastened to the second mounting flange 214 and the second mounting flange 214 is fixed to the frame 210. In one or more embodiments, the ion grids 206*a-b*, 212*a-b* are metal plates with a hole in their centers to restrict the ion beam diameter and allow passage of the ions. In one or more further embodiments, the hole is covered with a wire grid. Typical embodiments of the present invention, however, do not use wires grids covering the hole.

A first focusing voltage applied to ion grid 206*a* and a second focusing voltage applied to ion grid 212*a* are used to focus the beam of ions (i.e., tailoring the beam diameter or the injection angle of the beam into the cavity 200). A first accelerating/decelerating voltage applied to ion grid 206*b* and a second accelerating/decelerating voltage applied to ion grid 212*b* are used to control the energy of the ions in the cavity. The focusing voltages and the accelerating/decelerating voltages are controlled by controller 104.

An electron multiplier (comprising a channeltron having a front 216 and a back 218) is also fastened to the first mounting flange 208 between the mounting flange 208 and the ion grids 206*a-b*. The front of the (commercially-available) channeltron is normally coated with a high secondary-emissive semiconducting surface, as are its channel walls. These allow for a high amplification (order of $10^6$) of the initial ion charge. Detection of the final current is made with a simple high-conductivity (e.g., copper) collector cup that is connected to a follow-on amplifier and counting circuit, to count the ions exiting cavity 200.

The EIB further comprises capacitive pickups 220, 222 mounted to a third mounting flange 224 at a center plane 226 of the cavity 200.

The frame 210 can comprise a chamber enclosing a buffer gas in the cavity.

In one or more embodiments, the EIB has a length L of 6.6", although other dimensions are possible.

An entry gate to the EIB can also be provided (not shown), as discussed in the next section.

Simulation

Figure 3:
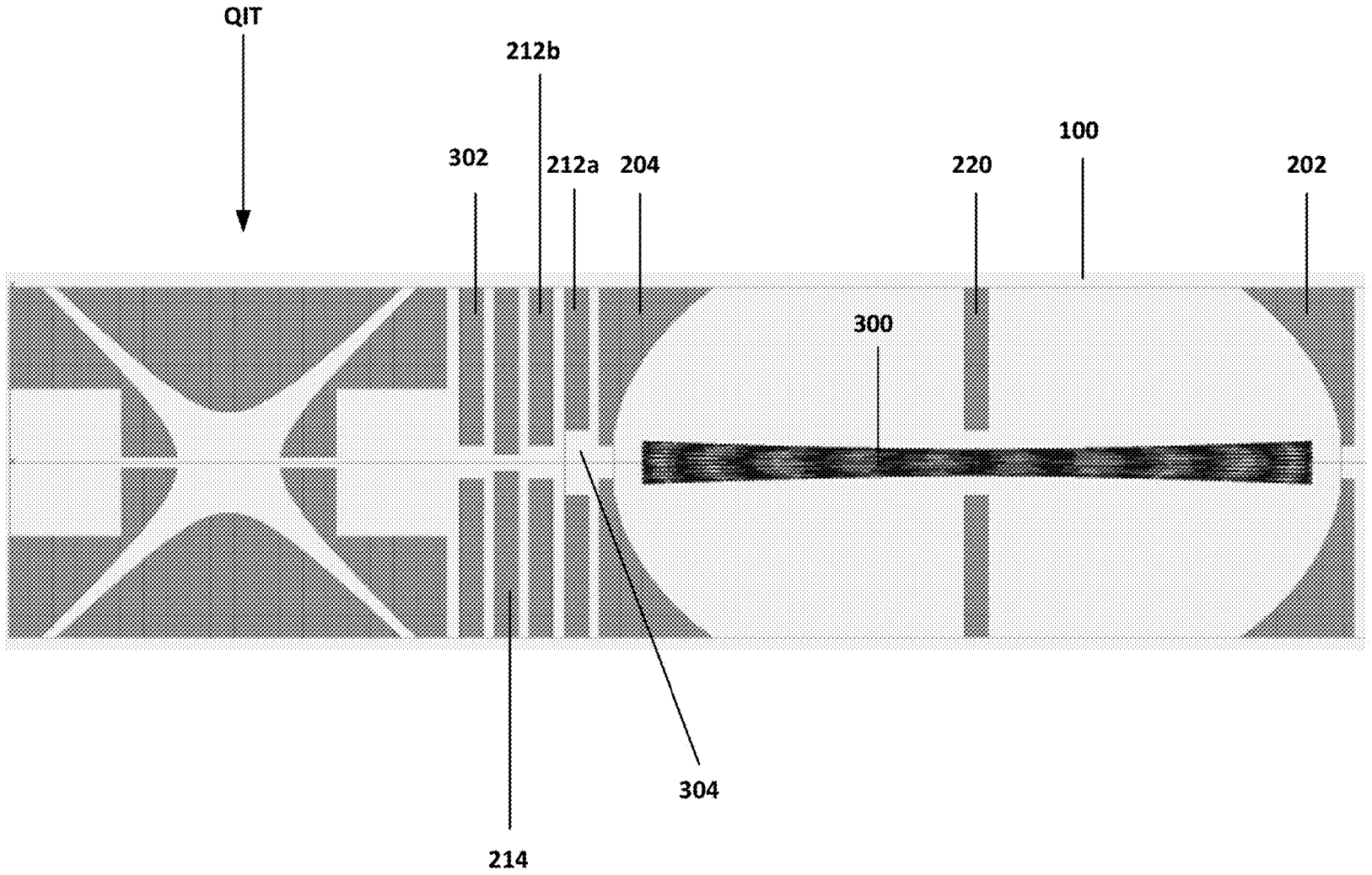
FIG. 3 is a simulation showing the calculated ion beam being multiply-reflected in the EIB according to one or more embodiments of the present invention.

FIG. 3 illustrates SIMION Fields-and-Trajectories-Code results for trapping of 90 eV-energy $^{134}Xe^{+}$ ions. Shown is an oscillating beam 300 of the ions in the cavity comprising the EIB coupled to the QIT. The simulation is made for an 8 mm-radius ion beam 300, with an ion injection half-angle of 10°. The calculated resolving power for the EIB used as a mass spectrometer can be in the range $m/\Delta m=10^5$-$10^6$. In the interface between the QIT and the EIB, care must be given to the ion-ejection timing and phase with respect to the EIB entry-gate timing. FIG. 3 further illustrates an entry gate 302 (comprising an electrode) at an interface between the EIB and the ion trap, wherein a timing and phase of a gate voltage applied to the entry gate with respect to transfer voltage(s) (applied to the ion trap to eject the ions from the ion trap) are selected such that the gate voltage opens the entry gate allowing the ions ejected from the trap to pass into the cavity 200. The transfer and gate voltages are set by controller 104.

Also shown in FIG. 3 are apertures 304 in the entry gate 302, ion grids 212*a-b*, flange 214, and mirrors 202, 204 to allow passage, entry, and reflection of the ions.

Mass Measurement

Figure 4:
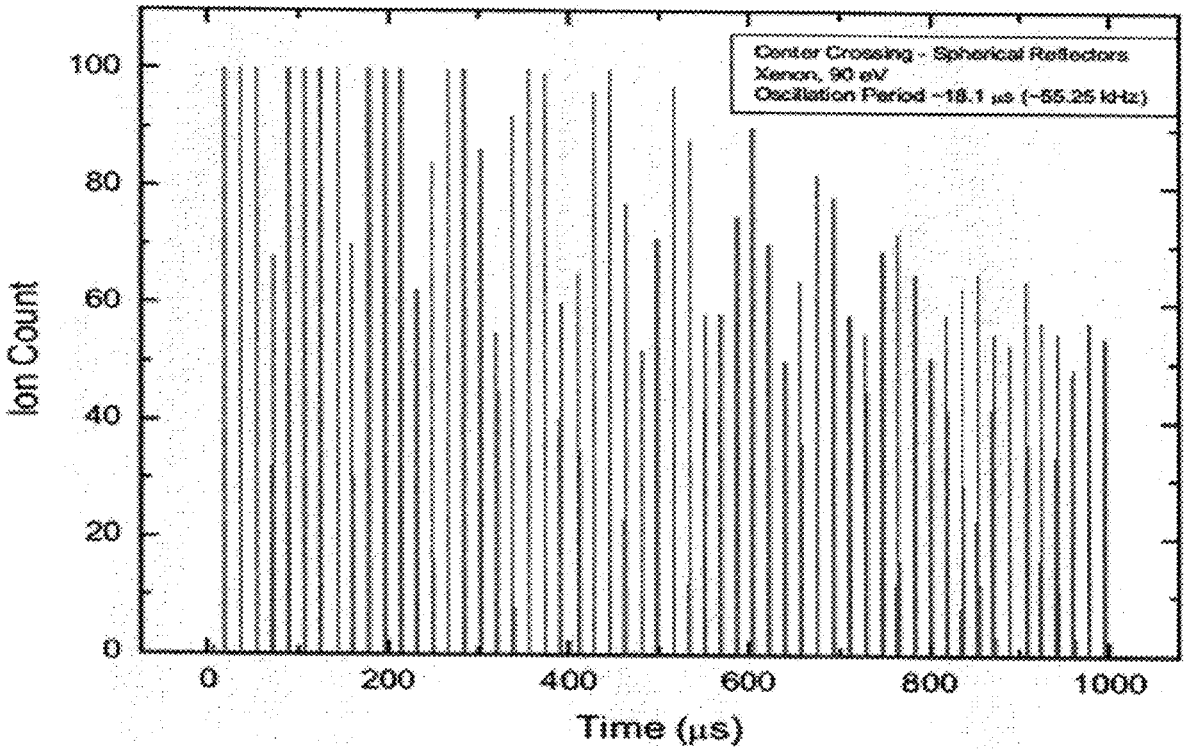
FIG. 4 illustrates the simulated oscillation spectrum for center plane crossings of a $^{134}Xe^{+}$ ion in the EIB comprising a spherical resonator, according to one or more embodiments of the present invention.

FIG. 4 illustrates simulated spectra for center plane crossing of a $^{134}Xe^{+}$ ion in the EIB comprising a spherical resonator, showing the 90 eV $^{134}Xe^{+}$ ion with a period of 18.1 microseconds (μs), corresponding to a frequency of 55.25 kHz (i.e., a 90 eV $^{134}Xe^{+}$ ion crosses the center of the cavity every 18.1 μs). The nearby, lighter $^{132}Xe^{+}$ isotope has a period of 18.0 μs (55.67 kHz).

The mass of any unknown ion can be calculated from the spectra because the travel time (period) for an ion to complete one round trip (e.g., travel time from the first mirror 202 to the second mirror 204 and back to the first mirror 202) in the cavity depends on the (known) kinetic energy and the (unknown) mass of the ion. The difference (ΔT) in travel time (or period) of two masses $m_1$ and $m_2$ is proportional to n $(m_2^{1/2}-m_1^{1/2})$, where n is the number of passes in the cavity of the EIB.

In practice, the spectra for the center plane crossings is measured using the capacitive pickup electrodes 220 and 222, wherein these capacitive pickups record the image charges for these ion crossings (an ion crossing is an event wherein the ions cross the center plane 226 of the cavity 200). The spectra can then be obtained by Fourier Transform of the time-resolved image charges.

In one or more embodiments, the mass m is determined with a resolving power (m/Δm) of at least $10^5$ where Δm is an uncertainty in the measured mass. This resolution is achieved by one or more of the following.

1. Proper alignment of the mirrors and the EIB with the ion trap (QIT). The mechanical support and alignment of the EIB are highly critical and can be achieved by coaxially aligning the electrodes (ion grids 206*a-b*, 212*a-b* and entry gate 302, the detectors (channeltron and capacitive pickup electrodes), the mirrors 202, 204, and the ion trap (QIT) along the longitudinal central axis 228 of the cavity 200; and mechanically connecting the electrodes 206*a-b*, 212*a-b*, 302, the detectors, mirrors, and the ion trap to the same frame 210 or enclosure 100.
2. Using the focusing voltages applied to the ion grids to control the injection angle of the ions from the QIT into the cavity 200; and focusing the ions with an optimal diameter into the cavity.
3. Using the accelerating/decelerating voltages applied to the ion grids to control the energy and energy width of the ions in the cavity.
4. Using the transfer voltages to control the density of ions in the cavity to avoid space-charge energy and angular-broadening effects.

Process Steps

Figure 5:
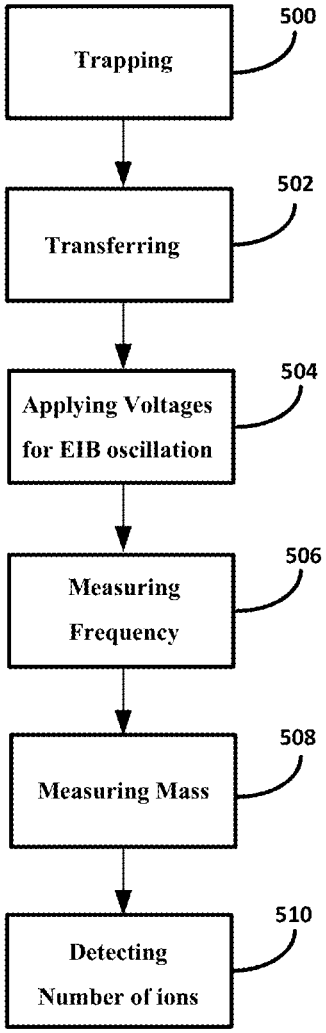
FIG. 5 is a flowchart illustrating a method of measuring mass according to one or more embodiments of the present invention.

FIG. 5 is a flowchart illustrating a method of measuring a mass of an ion; e.g., using the apparatus illustrated in FIGS. 1-3. The method comprises the following steps.

Block 500 represents trapping a pre-determined number of one or more ion types (different masses) in an ion trap (e.g., QIT). As used herein, an ion type is an ion with a particular mass and charge state (positive or negative).

Block 502 represents transferring (gating) one or more of the ion types to an EIB interfaced with the ion trap, the EIB comprising a cavity 200 bounded by a first (metal) mirror 202 and a second (metal) mirror 204 at opposite ends of the cavity 200.

The step can comprise applying one or more transfer voltages to electrodes 102 of the ion trap to eject one or more of the ion types from the ion trap, forming an ejected ion beam; and applying a gate voltage to an entry gate 302 at an interface between the EIB and the ion trap. A timing and phase of the gate voltage with respect to the transfer voltages is selected/controlled by a control unit 104 such that the gate voltage opens the entry gate allowing the ejected ions to pass into the cavity 200. The number of ions injected into the cavity per unit time can be controlled or pre-determined.

Block 504 represents applying voltages to the mirrors 202-204 using a control unit 104. This control unit is capable of controlling all voltages on the electron optics and ion optics in the QIT and EIB; controlling the timing (phasing) of the ion exit from the QIT and entry into the EIB; measuring the pulse timing and pulse amplitude of the image charges at the EIB; and controlling ejection of the ions in the EIB to the channeltron detector. Processors and voltage supplies typically used to control and bias the QIT can also be used to control and bias the EIB (for example, a desktop computer can be used for controlling all the voltages).

Once the ion types are pulsed ("gated") into the EIB cavity 200, voltages are applied to mirrors 202 and 204. The electrostatic field at mirror 202 repels the ions towards the second mirror 204, where they are reflected back to mirror 202. This results in the ions' oscillating in the cavity between the first mirror 202 and the second mirror 204, with an oscillation period unique to each ion mass. The timing, phase, and voltages are controlled by the control unit 104 to achieve the resonant reflections of the one or more ion types through the cavity 200.

Electrodes (ion grids 206*a*, 212*a*) are positioned and biased with focusing voltages that focus the one or more ion types in the cavity. Electrodes (ion grids 206*b*, 212*b*) are positioned and biased with accelerating/decelerating voltages that accelerate and/or decelerate the one or more ion types in the cavity. In one or more embodiments, the voltages on the two mirrors are set to the same voltage (or with slight adjustment to account for alignment errors) and the reflections proceed, without having to change the voltages again for each reflection.

Block 506 represents measuring a (e.g., resonant) frequency of oscillation/oscillation period of the ions in the cavity. The measured oscillation period represents a time taken for each of the ion types to perform a round trip oscillation in the cavity (starting at one plane 226 in the cavity and returning by crossing same plane 226 after one reflection at the first mirror and one reflection at the second mirror). The step can comprise measuring one or more frequencies/oscillation periods for one or more known masses and for one or more unknown masses. The frequencies/oscillation periods can be determined from data measured using a capacitive pickup electrode at the center plane 226 of the cavity.

Block 508 represents determining a mass of each of the ion types from the frequency/oscillation period. The determining comprises comparing the frequency/oscillation period for the unknown mass with the frequency/oscillation period for the known mass. In one or more embodiments, the frequencies/oscillation periods measured in Block 506 are used to calculate $\Delta T \sim n\,(m_2^{1/2}-m_1^{1/2})$. Assuming one of the masses $m_1$ or $m_2$ is known (and the number of passes n is also known), the unknown mass can be determined.

Block 510 represents detecting a number of the each of the ion types oscillating with the frequency/oscillation period in the cavity. The electron multiplier (e.g., channeltron detector) positioned after mirror 202 counts the total number of the ions (comprising all ion types) exiting the EIB. In one or more embodiments, the detecting counts the number of ions exiting the cavity per unit time through an aperture in the mirror 202. It is interesting to point out that some of the ions in the cavity will be neutralized by collisions with the residual gas in the cavity. This loss in the total number of ions oscillating/stored in the cavity can be calculated by taking the difference of the total number of ions injected into the cavity from the QIT, and the total number of ions exiting the cavity and counted at the channeltron detector.

Thus, one or more embodiments of the invention determine the mass and the abundance of an ion in a sample.

Possible Modifications

In one or more embodiments, the detailed ion-trapping properties of the EIB resonant cavity are studied to obtain higher resolution, more accurate isotope ratios, or greater ion capacity in a smaller device.

In one or more embodiments, the basic design of the EIB is studied using three-dimensional charged-particle fields-and-trajectory codes. The EIB can be optimized with respect to parameters such as resonator-cavity types (parallel-plate reflectors, parabolic reflectors, and others), ion injection angle, ion-beam diameter, energy width, density, mass resolution, and cavity length. A working laboratory system can then be built and interfaced to the QIT based on optimum designs provided by simulations.

The apparatus operates for negative ions as well as positive ions. One only needs to reverse the polarity of the voltage on each grid, mirror, electrode, etc. The use for negative ions is important in biological applications.

Examples of Applications

The prime candidates for the instrument (comprising a QIT coupled to and EIB according to one or more embodiments of the invention) are measurements in the dunes, lake, and atmosphere of environments such as Titan, where isotope-ratio measurements in the tholin species easily require resolving powers of the order of $10^5$. In addition, one or more embodiments of the QIT-EIB system will be valuable in understanding the composition of unknown targets, such as a Martian or asteroid surface that may provide evidence of extinct or extant biological activity. For these measurements, the high-mass capability, flexibility of mass storage, accurate isotope-ratio measurements, and high sensitivity afforded by one or more embodiments of the QIT-EIB instrument are required.

One or more embodiments of the QIT-EIB system can also be used in the pharmaceutical industry for evaluating high-mass proteins and drugs. In addition, the system can be used to understand, on a cellular level, the effects of long-duration space travel on astronauts. During extended periods of proton (cosmic-ray) bombardment, and heavy-ion bombardment without the protective magnetic field of the Earth, the human body is subject to ageing and cancers. Such physiological changes must be studied on the metabolomic level to assess the full risk of, say, a mission to Mars. These medical uses require high sensitivity and high mass resolving powers of order $m/\Delta m=20{,}000$ amu/0.1 amu$=2\times10^5$.

Advantages and Improvements

The inventors are not aware of any existing, coupled QIT-EIB system. The ion trap-EIB system according to one or more embodiments of the invention can be a powerful tool, representing a combination of an already sensitive, selective, flexible, and high-resolution QIT with an EIB having unprecedented resolution and single particle detection sensitivity. Furthermore, one or more embodiments of the present invention can be adapted for space-flight needs (or other systems of low mass-volume-power). In one or more embodiments, all hardware and electronics builds could adhere to a flight architecture as reasonably as possible, to result in a prototype laboratory design in the NASA Technology Readiness Level 4 (TRL4) category.

CONCLUSION

This concludes the description of the preferred embodiment of the present invention. The foregoing description of one or more embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A method of measuring the mass of one or more ion types, comprising:

trapping one or more ion types in an ion trap;

transferring (gating) one or more of the ion types to an electrostatic ion bottle (EIB) interfaced with the ion trap, the EIB comprising a cavity bounded by a first electrostatic mirror and a second electrostatic mirror at opposite ends of the cavity;

applying a first voltage to the first mirror and a second voltage to the second mirror, with a timing and phase between the first and second voltages, wherein an electrostatic field at the first mirror resulting from the first voltage repels the one or more ion types at the first mirror towards the second mirror, and an electrostatic field at the second mirror resulting from the second voltage repels the one or more ion types at the second mirror towards the first mirror, thereby causing the one or more ion types to resonantly oscillate between the first and second mirrors, each of the ion types with its unique oscillation period;

measuring the oscillation period representing a time taken for each of the ion types to perform oscillations in the cavity;

detecting the number of each of the ion types in the cavity having that oscillation period; and determining the mass of each of the ion types from its oscillation period.

2. The method of claim 1, wherein the transferring comprises:

applying one or more transfer voltages to electrodes of the ion trap to eject the one or more of the ion types from the ion trap, forming an ejected ion beam;

applying a gate voltage to an entry gate at an interface between the EIB and the ion trap; and wherein a timing and phase of the gate voltage with respect to the transfer voltages is selected such that the gate voltage opens the entry gate allowing the ejected ion beam to pass into the cavity.

3. The method of claim 2, further comprising:

biasing electrodes in the EIB and coupled to the cavity, with focusing voltages that focus the one or more ion types in the cavity, and biasing electrodes positioned in the EIB and coupled to the cavity, with accelerating/decelerating voltages that accelerate or decelerate the one or more ion types in the cavity.

4. The method of claim 3, wherein:

the electrodes, the detectors, the mirrors, and the ion trap are mechanically connected to, and supported by a frame, the electrodes, the detectors, the mirrors, and the ion trap are coaxially aligned along the longitudinal axis of the cavity, the focusing voltages control the injection angle of the one or more ion types into the cavity and focus the one or more ion types into an ion-beam having a diameter, the accelerating/decelerating voltages control the energy and energy width of the one or more ion types in the cavity, the transfer voltages control a density of the one or more ion types in the cavity, such that the mass m is determined with a resolving power (m/Δm) of at least $10^5$, where Δm is an uncertainty in the measured mass.

5. The method of claim 1, further comprising measuring the oscillation period for a known mass of one of the ion types, wherein the determining comprises comparing the oscillation period for the known mass with the period for the mass of one of the ion types comprising an unknown mass.

6. The method of claim 1, further comprising measuring the oscillation period using a capacitive pickup electrode at the center plane of the cavity.

7. The method of claim 1, wherein the detecting counts the total number of the ions of all the ion types in the cavity using an electron multiplier positioned behind the downstream mirror.

8. The method of claim 1, wherein the ion trap is a quadrupole ion trap.

9. The method of claim 1, further comprising tuning the timing, the phase, and magnitudes of the first and second voltages, causing the ion types to resonantly oscillate in the cavity between the first mirror and the second mirror.

10. The method of claim 1, wherein the one or more ion types are either all negative ions or all positive ions.

11. An apparatus for measuring the mass of one or more ions types, comprising:

an ion trap;

an Electrostatic Ion Bottle (EIB) comprising a cavity bounded by a first mirror and a second mirror at opposite ends of the cavity, the mirrors coaxially aligned along a longitudinal axis of the cavity;

an entry gate comprising an electrode interfacing the EIB with the ion trap, the entry gate transferring one or more of the ion types ejected from the ion trap to the cavity;

one or more control processors controlling timing, phase, and magnitudes of a first voltage applied to the first mirror and a second voltage applied to the second mirror, the electrostatic field at the first mirror repelling the one or more ion types at the first mirror towards the second mirror, and an electrostatic field at the second mirror repelling the one or more ion types at the second mirror towards the first mirror, thereby causing the one or more ion types to resonantly oscillate in the cavity between the first and second mirrors, each of the ion types with its unique oscillation period;

a first detector, comprising capacitive pickup electrodes, coupled to the cavity and measuring the oscillation period representing a time taken for each of the ion types to perform oscillations in the cavity, the oscillation period used to determine a mass of each of the ion types; and a second detector coupled to the cavity and detecting the total number of ions of all types that were stored in the cavity.

12. The apparatus of claim 11, wherein the ion trap is a quadrupole ion trap.

13. The apparatus of claim 11, wherein the one or more processors control application of:

one or more transfer voltages to electrodes of the ion trap to eject the one or more ion types from the ion trap; and a voltage to the entry gate, wherein a timing and phase of the gate voltage with respect to the transfer voltages are such that the gate voltage opens the entry gate allowing the one or more ion types to pass into the cavity.

14. The apparatus of claim 13, further comprising a processor connected to the EIB, wherein the processor determines the mass from the oscillation period.

15. The apparatus of claim 14, wherein the processor determines the mass comprising an unknown mass of one ion type by comparing the oscillation period obtained for the unknown mass of the one ion type with the oscillation period obtained for the known mass of another of the ion types.

16. The apparatus of claim 14, wherein the EIB further comprises:

electrodes positioned and biased with focusing voltages that focus the one or more ion types in the cavity, and electrodes positioned and biased with accelerating/decelerating voltages that accelerate and/or decelerate the one or more ion types in the cavity.

17. The apparatus of claim 16, wherein:

the electrodes, the detectors, the mirrors, and the ion trap are mechanically connected to and supported by a frame, the electrodes, the detectors, the mirrors, and the ion trap are coaxially aligned along the longitudinal axis of the cavity, the focusing voltages control the injection angle of the one or more ion types into the cavity and focus the one or more ion types into an ion-beam having the accelerating/decelerating voltages control an energy width of the one or more ion types in the cavity, the transfer voltages control a density of the one or more ion types in the cavity, such that the mass m is determined with a resolving power (m/Δm) of at least $10^5$ where Δm is an uncertainty in the measured mass.

18. The apparatus of claim 14, wherein the second detector comprises a channeltron electron multiplier positioned behind the downstream mirror, the second detector counting the total number of ions of all types stored in the cavity.

19. The apparatus of claim 11, wherein the capacitive pickup electrodes are at the center plane of the cavity, and the capacitive pickup electrodes output data from which the oscillation periods of the various ion types are measured.

20. The apparatus of claim 11, wherein the one or more ion types are negative ions or positive ions.

* * * * *